US008640982B2

(12) United States Patent
Nash et al.

(10) Patent No.: US 8,640,982 B2
(45) Date of Patent: Feb. 4, 2014

(54) STRIP MATERIAL DISPENSING DEVICE

(75) Inventors: Jorge A. Nash, Vancouver, WA (US); Orion A. Cavins, Vancouver, WA (US); Neil S. Schwinler, Vancouver, WA (US); Thomas J. Barron, Vancouver, WA (US)

(73) Assignee: Adalis Corp., Vancouver, WA (US)

( * ) Notice: Subject to any disclaimer, the term of this patent is extended or adjusted under 35 U.S.C. 154(b) by 1062 days.

(21) Appl. No.: 12/581,611

(22) Filed: Oct. 19, 2009

(65) Prior Publication Data

US 2011/0089214 A1 Apr. 21, 2011

(51) Int. Cl.
*B65H 23/04* (2006.01)
*B65H 23/038* (2006.01)

(52) U.S. Cl.
USPC ..... 242/615.1; 226/19; 226/174; 226/189

(58) Field of Classification Search
USPC ..... 226/3, 4, 18–23, 109, 174, 189; 242/563.1, 566, 615.1; 156/554, 555, 156/574; 74/89.22
See application file for complete search history.

(56) References Cited

U.S. PATENT DOCUMENTS

| | | | | |
|---|---|---|---|---|
| 2,911,835 | A * | 11/1959 | Smith | 74/37 |
| 3,093,344 | A * | 6/1963 | Lamb | 242/481.4 |
| 3,177,751 | A * | 4/1965 | Vercauteren | 83/364 |
| 3,245,594 | A * | 4/1966 | Pendleton | 226/190 |
| 4,120,740 | A * | 10/1978 | Morgan et al. | 156/522 |
| 4,452,837 | A | 6/1984 | Clausen et al. | |
| 4,481,054 | A | 11/1984 | Clausen et al. | |
| 4,995,937 | A | 2/1991 | Persson | |
| 5,507,432 | A | 4/1996 | Cyr | |
| 5,759,339 | A | 6/1998 | Hartman | |
| 5,775,629 | A | 7/1998 | Cyr | |
| 5,820,062 | A * | 10/1998 | Menegatto | 242/481.3 |
| 5,942,077 | A * | 8/1999 | Tang | 156/361 |
| 6,596,111 | B2 | 7/2003 | Cyr et al. | |
| 6,688,363 | B2 | 2/2004 | Cyr et al. | |
| 6,705,500 | B2 | 3/2004 | Shea et al. | |
| 6,737,138 | B2 | 5/2004 | Cyr et al. | |
| 6,981,537 | B2 | 1/2006 | Cyr et al. | |
| 7,222,653 | B2 | 5/2007 | Robitaille et al. | |

(Continued)

FOREIGN PATENT DOCUMENTS

| | | |
|---|---|---|
| DE | 44 24 197 | 1/1996 |

OTHER PUBLICATIONS

Fordo FasTrack™ Beam Video at http://www.acptoday.com/Forbo%20Fastrack-1.html.

*Primary Examiner* — Sang Kim
*Assistant Examiner* — Scott Haugland

(57) ABSTRACT

An apparatus for dispensing strip materials onto one or more moving substrates includes a frame extending transversally of the substrate path that supports guide arms. Each guide arm includes pulleys for dispensing strip materials and is able to be moved along the frame by a friction drive system, which includes crank shafts, pulleys, and cables. Each guide arm can be held in position by a friction braking system, which includes members that are pressed against components of the drive system to frictionally prevent motion. A position feedback system measures and displays the location of the guide arms. A substrate tracking and adjustment system tracks the position of the substrate as it moves side to side from a normal path and automatically adjusts the position of the frame along a guide track to maintain the guide arms in a desired position in relation to the substrate.

18 Claims, 21 Drawing Sheets

(56) References Cited

U.S. PATENT DOCUMENTS

| | | | |
|---|---|---|---|
| 7,255,255 | B2 | 8/2007 | Shea et al. |
| 7,368,159 | B2 | 5/2008 | Smith et al. |
| 2002/0139470 | A1 | 10/2002 | Robitaille et al. |
| 2003/0056894 | A1 | 3/2003 | Getz et al. |
| 2005/0199333 | A1 | 9/2005 | Cyr et al. |
| 2007/0074817 | A1 | 4/2007 | Cyr et al. |

* cited by examiner

STRIP MATERIAL DISPENSING DEVICE

BACKGROUND

1. Field

This disclosure relates to an apparatus for dispensing strip materials onto a moving substrate, such as paper-like material in a laminating or corrugating machine.

2. Related Art

U.S. Pat. Nos. 6,705,500; 5,759,339; 7,222,653 and 7,255,255; and Canadian Patent No. 2,342,495 disclose embodiments of strip material dispensing machines.

BRIEF SUMMARY

In one embodiment disclosed herein there is described an apparatus for dispensing strip materials onto one or more moving substrates. The apparatus includes a frame extending transversally of the substrate path, the frame supporting at least one guide arm and a guide arm positioning system. Each guide arm includes means for dispensing strip materials and can be independently moved along the frame by the guide aim positioning system. The guide arm positioning system includes at least one crank shaft coupled to a first end of the frame, such that each crank shaft can rotate about an independent axis per crank shaft. The guide arm positioning system also includes at least one friction drive means coupled to each crank shaft and to a corresponding guide arm, wherein each friction drive means depends on frictional contact between two surfaces to transfer rotational movement of a crank shaft to linear motion of a guide arm. Each guide arm is independently movable along the frame by rotation of a corresponding crank shaft.

Each friction drive means can include one or more drive pulley and tail pulley pairs, and cables that extend around each pair of drive and tail pulleys and that are fixed to a guide arm therebetween. A friction braking means can also be included to hold the guide arms in position, which can include various members that can be pressed against components of the drive system to frictionally prevent their motion.

The apparatus can also include a guide arm position feedback system that can include a magnet attached to each guide arm and a transducer attached to the frame which interact with a remote control panel to measure and display the location of the guide arms.

The apparatus can further include a substrate tracking and adjustment system that includes a controller, an actuator, and a sensor that can track the position of the substrate as it moves side to side from the normal substrate path and automatically adjust the position of the frame to match. In one embodiment, a linear actuator can adjust the transversal location of the frame relative to the substrate in response to a signal from the substrate sensor means, thereby adjusting all of the mounted guide arms in unison. The sensor can sense the substrate position and transmit the position information to a controller that can send a command signal to the actuator to move the frame to be aligned with the substrate position. As the frame moves, so do the guide arms supported by the frame. This sensing, comparing, and adjusting loop can be done repeatedly to maintain the frame and guide arms in the desired position in relation to the substrate.

Also disclosed herein is a process that includes three steps for preparing to dispense strip materials onto a moving substrate. Step one includes rotating at least one crank shaft coupled to a first end of a frame such that each crank shaft can rotate about an independent axis per crank shaft, the frame extending transversally of the substrate path, each rotating crank shaft thereby actuating a friction drive means, one friction drive means being coupled to each crank shaft and a corresponding guide arm, each friction drive means depending on frictional contact between two surfaces to transfer rotational movement of the crank shaft to linear motion of a guide arm, each friction drive means thereby moving the corresponding guide arm to a desired position along the frame, each guide arm having a supporting means to movably couple the guide arm to the frame and a dispensing means for dispensing strip materials onto the substrate. Step two includes using a guide arm position feedback means to automatically determine the transversal position of each guide arm in relation to a predetermined position and display the positions on a display device. Step three includes repeating steps one and two until the display device displays the desired positions of the guide arms.

DETAILED DESCRIPTION

Disclosed herein is a compact, light weight, and easily floor-moveable apparatus for the dispensing of strip materials onto a moving substrate in a substrate processing machine. The apparatus includes at least one strip material dispensing guide arm that may be independently adjustable transversely of the direction of movement of the substrate.

The strip materials may be a ribbon material, such as tape, string and yarn, various web materials and various widths of material, particularly tapes that include an adhesive such as a hot melt adhesive, a hot melt pressure sensitive adhesive, a hot melt remoistenable adhesive, a water dispersible hot melt adhesive, a biodegradable hot melt adhesive or a repulpable hot melt adhesive, or heat activatable adhesives.

The substrate may be a film, non-woven web, paper product, paper board, carton blank, box board, corrugated board or other sheet material or web material, all of various widths.

The substrate processing machine may be a wet end, a dry end, or both a wet end and a dry end of a corrugation machine, a lamination machine, a carton press, a fiber reinforcement application machine, or other similar machines that processes a moving substrate. In some embodiments, the substrate processing machine can process more than one substrate at the same time, for example, one above the other, and can combine more than one substrate into a single substrate during the processing.

According to one embodiment, changing the position of any one or more of the dispensing guide arms is accomplished by turning a series of crankshafts located at a head end of the apparatus. As the guide arms are moved, a control box precisely displays the position of each of the guide arms. This combination of moving the guide arms from the head end of the apparatus and the precise guide arm position readout enables apparatus setup and fine calibration without removing the apparatus from the substrate processing machine.

Change in the position of the strip materials is dictated by the desired position of the strip material on the substrate and the later manufacturing of the substrate. Depending on the strength of the strip material, the same will be a suitable transverse reinforcement of the substrate or serve as a tear strip affording ease in opening the container to be formed from the substrate.

Figure 1:
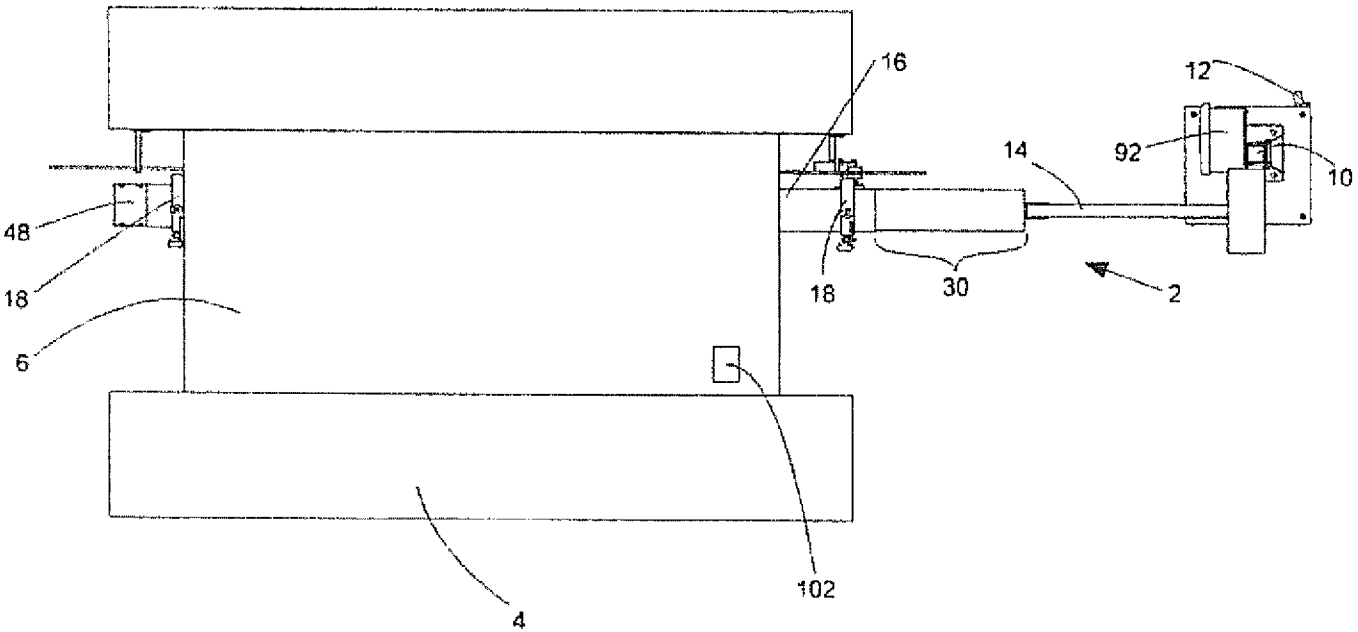
FIG. 1 is a top plan view of a strip material dispensing and positioning apparatus installed in a substrate processing machine.
Figure 2:
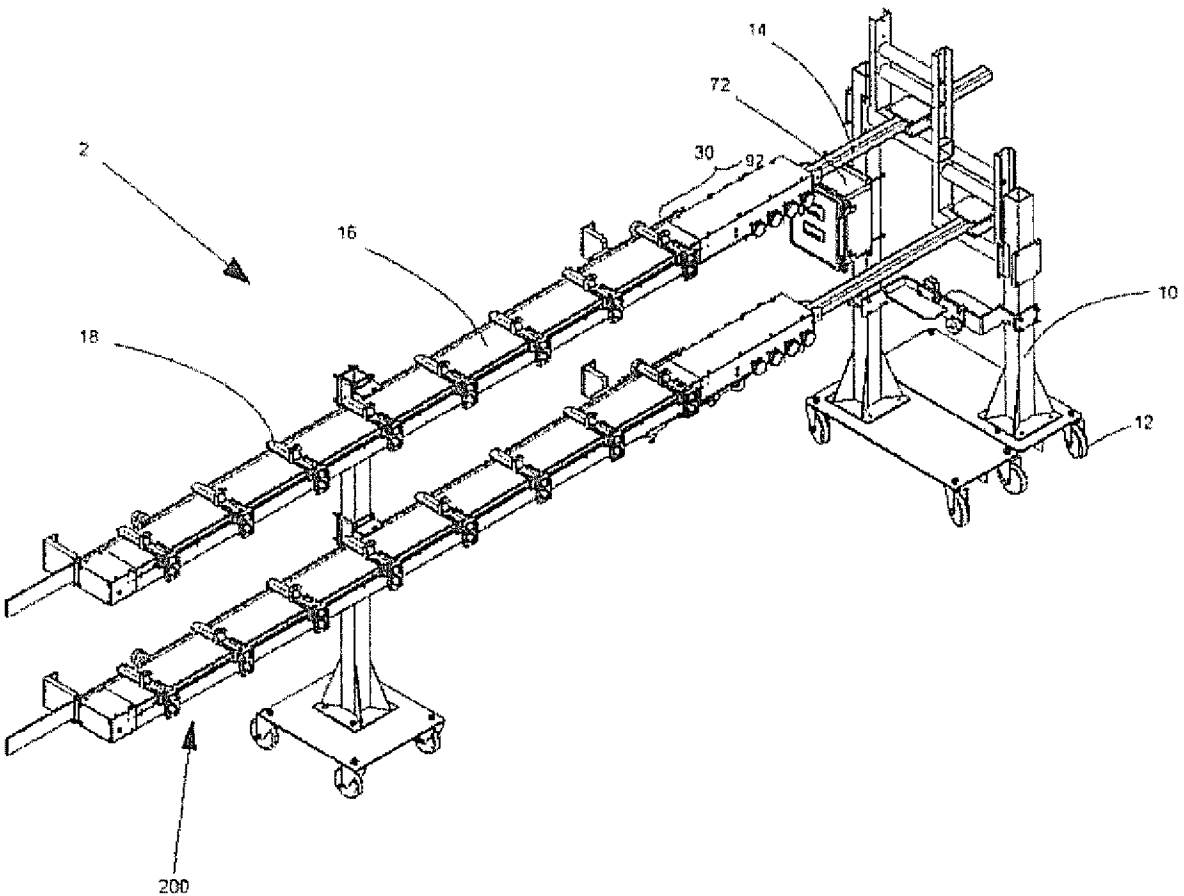
FIG. 2 is an isometric view of the apparatus of FIG. 1.
Figure 17:
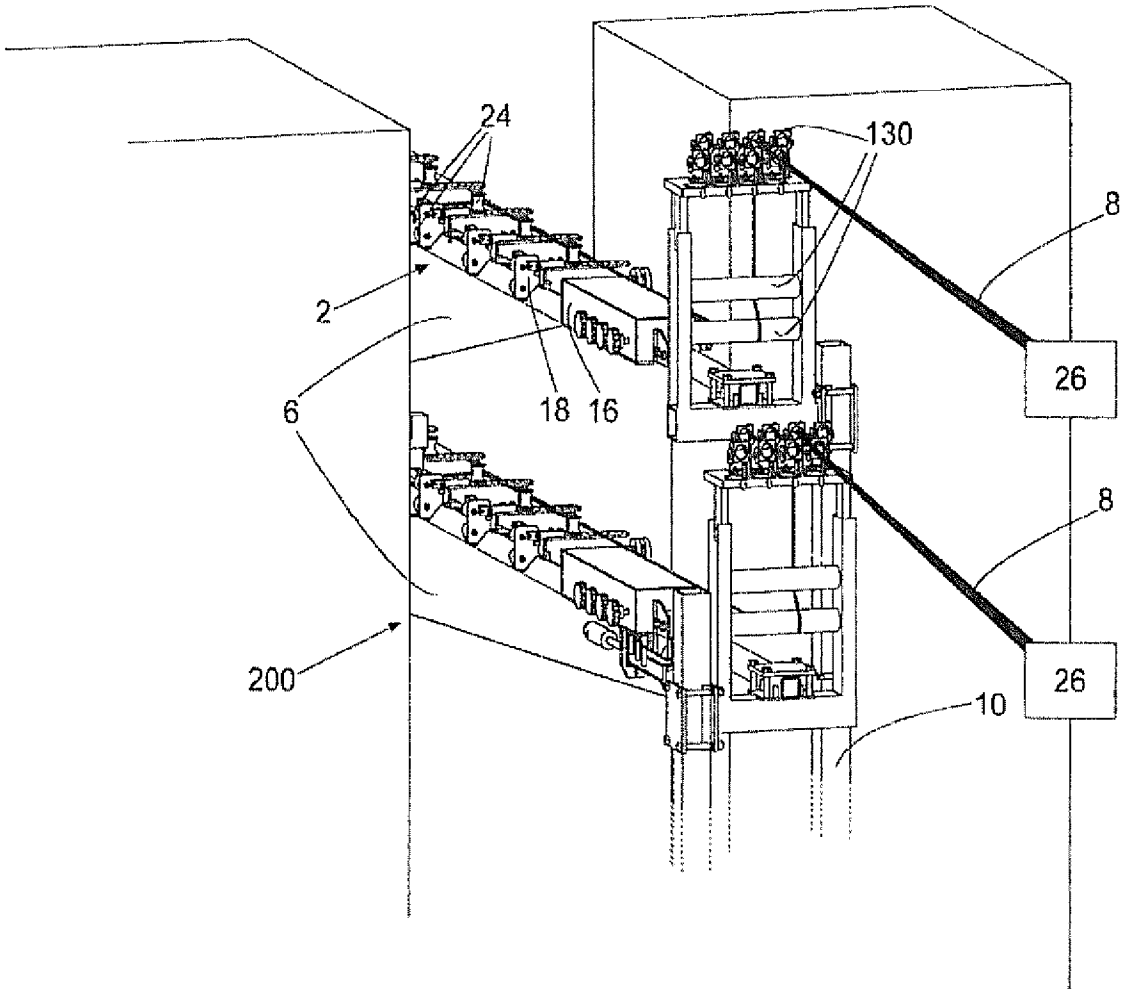
FIG. 17 is an isometric view of the apparatus of FIG. 1 and a second, similar apparatus both installed in a substrate processing machine and dispensing strip materials onto and between a pair moving substrates.

As illustrated in FIGS. 1 and 2, the apparatus, generally designated 2, is adapted to be positioned in various locations within a substrate processing machine 4. FIG. 1 shows one possible location. An apparatus 200, corresponding to the apparatus 2, can additionally be positioned in the substrate processing machine 4, for example above or below the apparatus 2, as shown in FIGS. 2 and 17. The apparatus 200 can be positioned on the opposite side of the substrate 6 to simultaneously apply strip materials 8 to the other side of the substrate 6. In other embodiments, the apparatus 200 can be positioned to apply strip materials to a second substrate. The apparatus 200 can be used, for example, when strip materials are to be applied between different layers of a laminated substrate, such as in the manufacturing of "double wall" or "triple wall" corrugated board, and/or when strip materials are to be applied both between layers of a substrate and on an outer surface of the same substrate. Since the apparatus 2 is similar to the apparatus 200, only the apparatus 2 is described further.

In some embodiments, two or more upright support towers 10 can hold the apparatus 2 in a generally horizontal position at a desired height above the ground. Each of these upright support towers 10 can be mounted on wheels 12 for increased mobility. The apparatus 2 and towers 10 can be wheeled in and out of the substrate processing machine 4. In one embodiment, after being wheeled into the machine 4, a portion of the apparatus 2, e.g. a guide track 110, can be fixed to and supported by the substrate processing machine 4, and one or more of the upright support towers can then be removed. In another embodiment, the upright support towers 10 can hold the apparatus 2 within the substrate processing machine 4 during operation and the apparatus 2 is not attached to the machine 4.

An extension member 14 can also be included to connect the apparatus 2 to an upright support tower 10 such that the tower can be located farther away from the laminating machine. The length of the extension member 14 can be adjustable, and in one embodiment, the extension member 14 has a hollow cross section.

The apparatus 2 includes an elongated frame 16. The frame 16 can be rectangular in cross section and can be constructed of aluminum. In certain embodiments, the frame 16 has a cross-sectional width of about 5.0 to 7.0 inches, and a cross-section height of about 4.25 inches. The frame 16 supports and encloses many components of the apparatus 2, shielding them from starch and other contaminants.

Figure 3A:
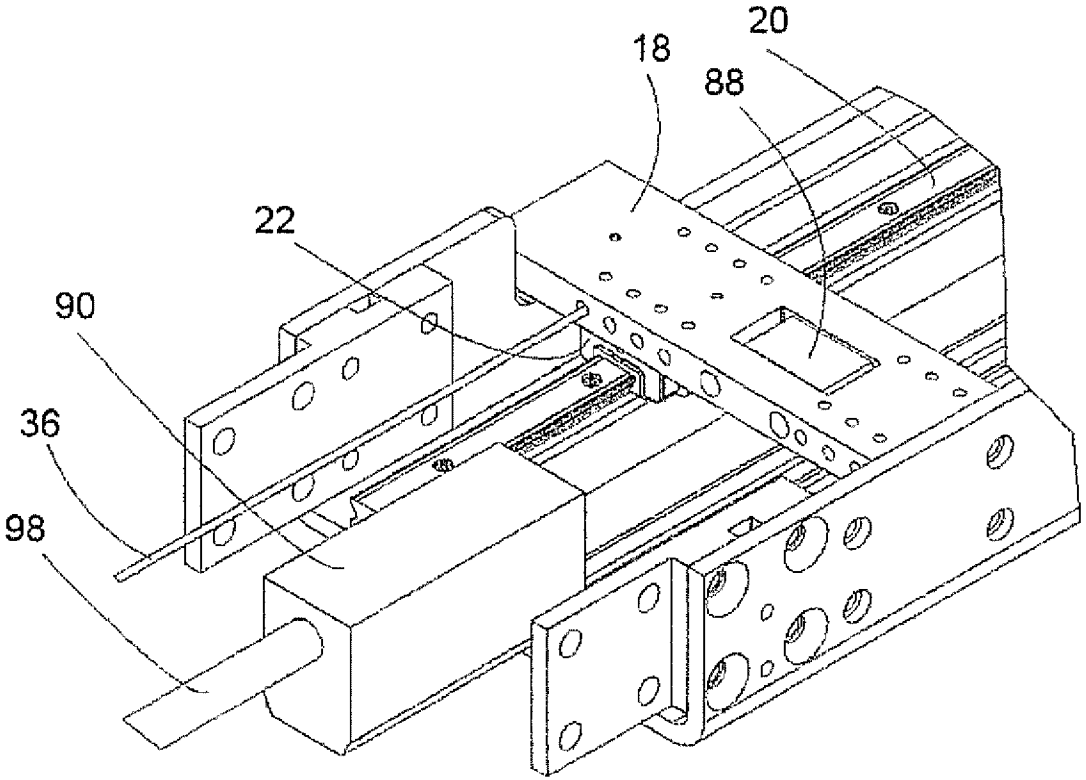
FIG. 3*a* is a detailed isometric view of part of the inner components of the apparatus of FIG. 1.
Figure 3B:
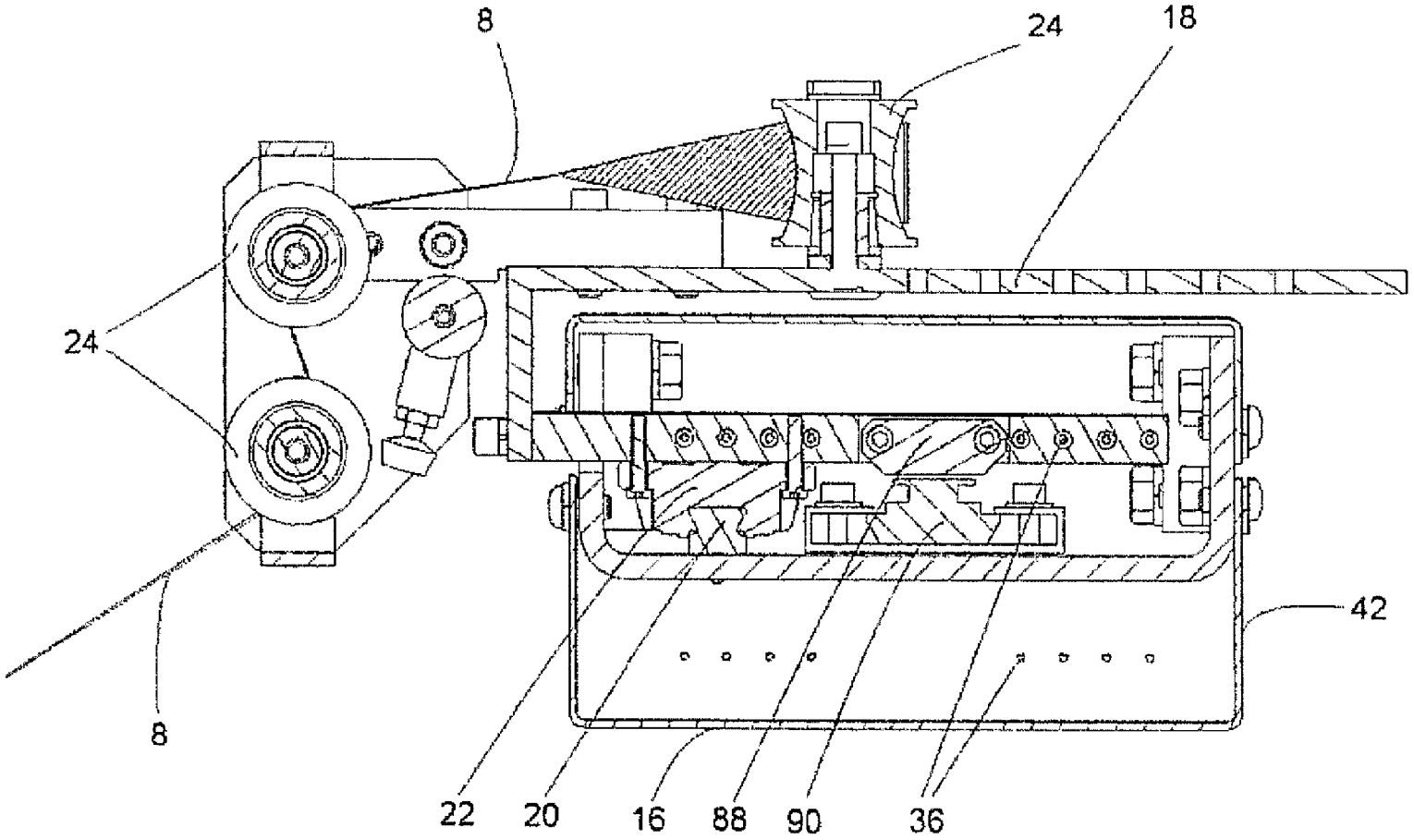
FIG. 3*b* is a detailed cross-sectional end view of the apparatus of FIG. 1.
Figure 4:
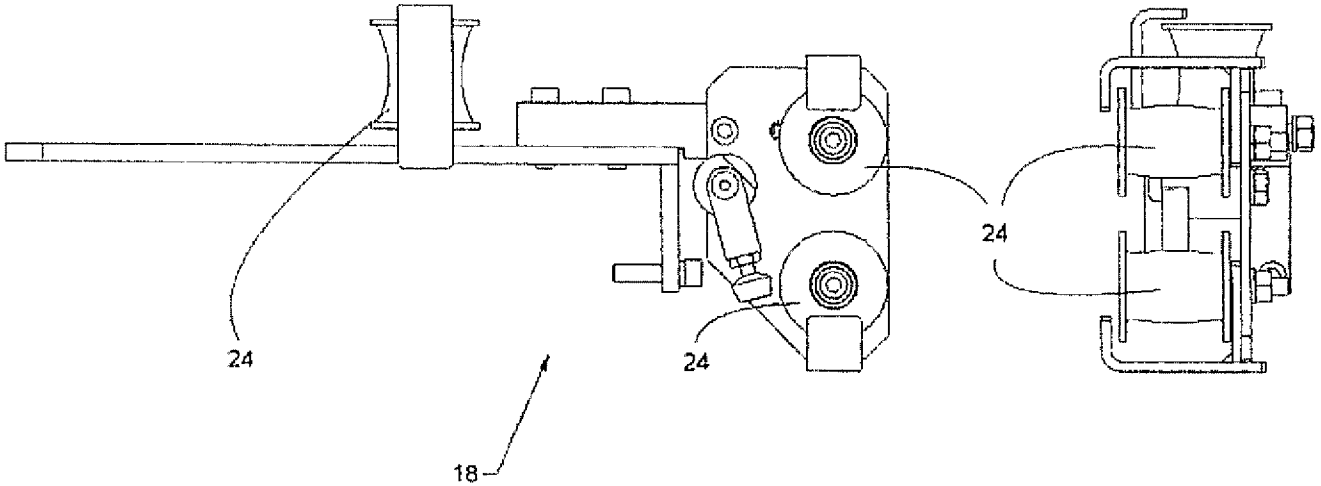
FIG. 4 is various orthogonal views of a guide arm of the apparatus of FIG. 1.

The frame 16 supports one or more guide aims 18 that can be mounted in a series along the length of the frame 16. As shown in FIGS. 3*a* and 3*b*, the frame 16 can also include a guide rail 20 fixed to the frame 16. Each guide arm 18 can include a component for coupling the guide arm 18 to the guide rail 20, for example a low friction sliding or rolling device, and in particular a linear bearing 22, which mates to the guide rail 20. Each guide arm 18 can have full range of the guide rail 20. As shown in FIG. 1, the frame 16 and guide rail 20 can extend transversally beyond the edges of the substrate 6 such that the guide arms 16 can be positioned beyond the edges of the substrate 6. As shown in FIG. 4, the guide arms 18 include pulleys 24 for receiving strip materials 8 that can be fed to the guide arms 18 transversely of the substrate from a remote supply 26 and then dispensed onto the substrate 6 for attachment and lamination thereto.

In certain embodiments, the frame 16 with mounted guide arms 18 and pulleys 24 can have a total cross-sectional width of about 12.1 inches and a total cross-sectional height of about 6.6 inches.

Figure 5:
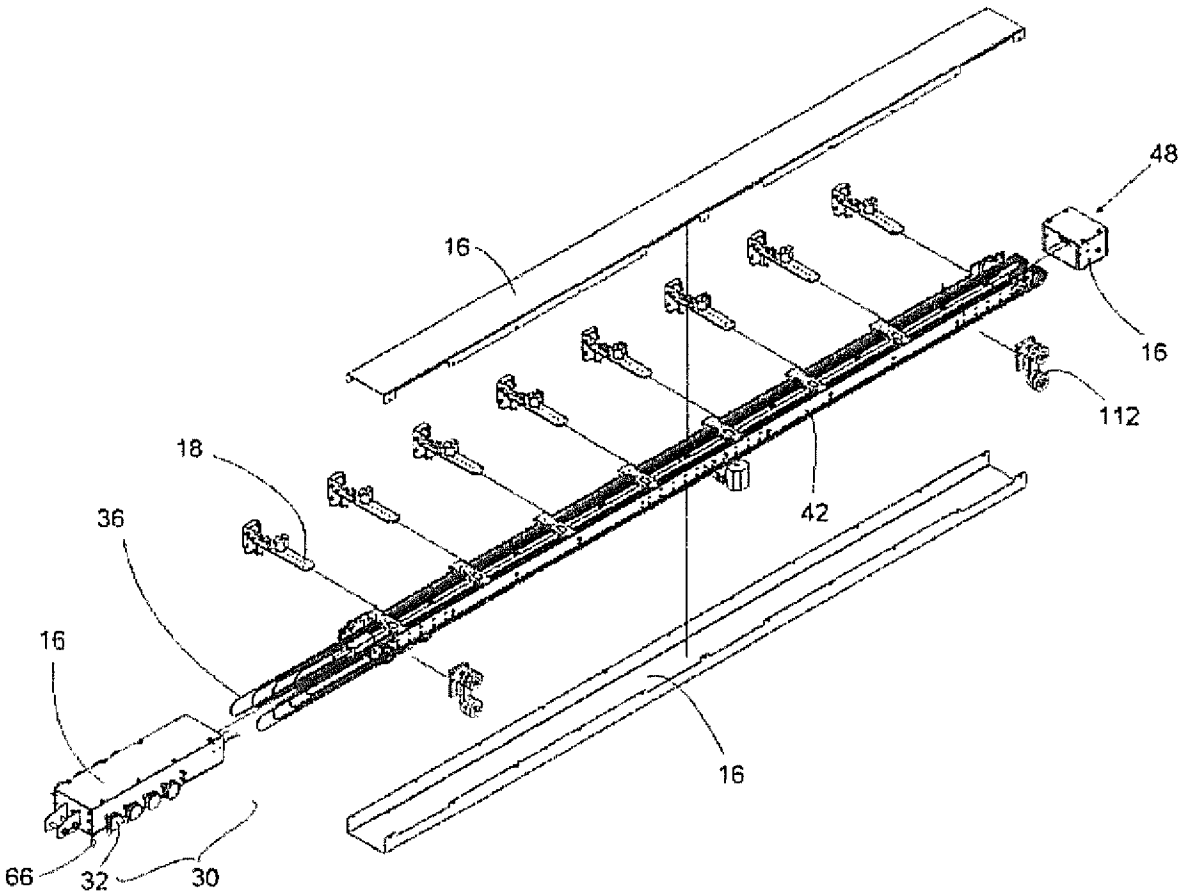
FIG. 5 is an exploded isometric view of the apparatus of FIG. 1.
Figure 6:
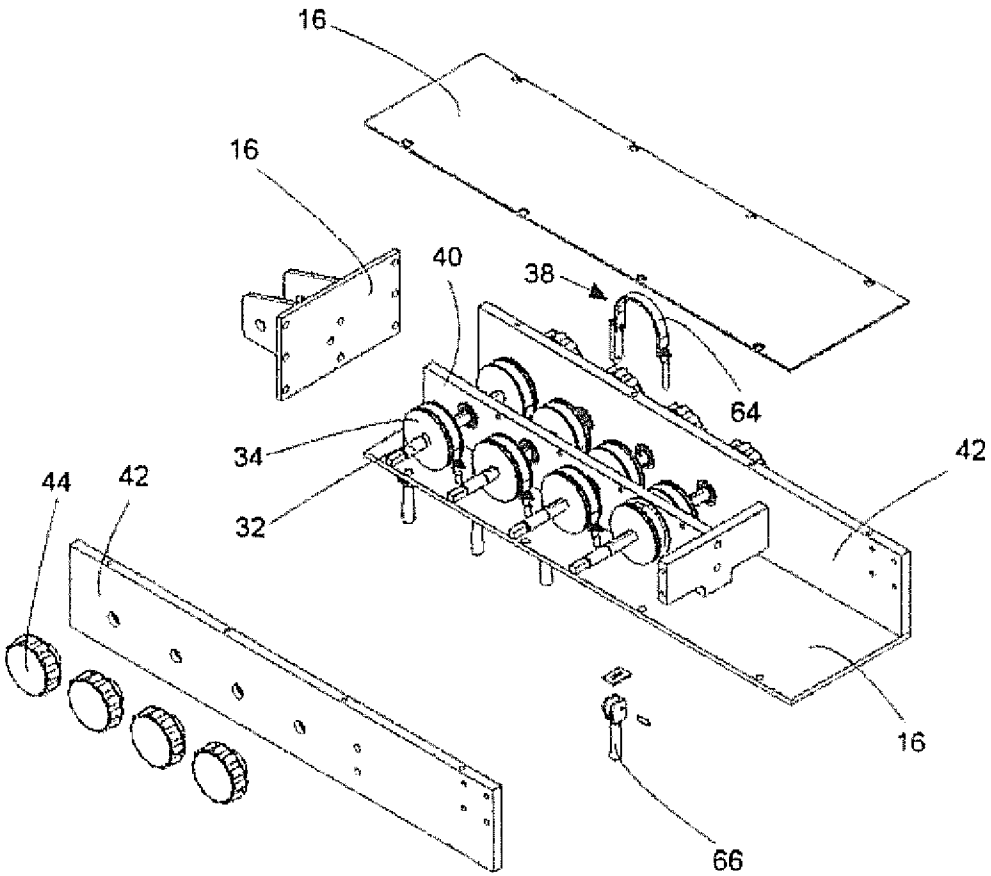
FIG. 6 is an exploded isometric view a user end of the apparatus of FIG. 1.

As shown in FIGS. 1, 2, and 5, a guide arm moving and holding assembly 30 can be located at an end of the frame 16 generally separate from the portion of the frame where the guide arms 18 are mounted. As shown in FIG. 6, the guide arm moving and holding assembly 30 can include at least one, and preferably a series of series of crank shaft(s) 32, head pulley(s) 34, cable(s) 36, and brake system(s) 38.

In one embodiment, a series of crank shafts 32 are rotably supported by the sides 42 of the frame 16 along parallel, horizontal axes. Pairs of shafts can be supported by the frame 16, side by side along the same axis. In this format, a center member 40 of the frame 16 is vertically disposed between the two crank shafts 32 and supports the inner ends of both crank shafts 32 such that they can rotate independently. The outer ends of the crank shafts 32 pass through opposite side walls 42 of the frame 16 and are connected to drive mechanisms 44. The drive mechanisms 44 can be manual cranks or automated devices, such as electric motors or actuators.

Figure 7A:
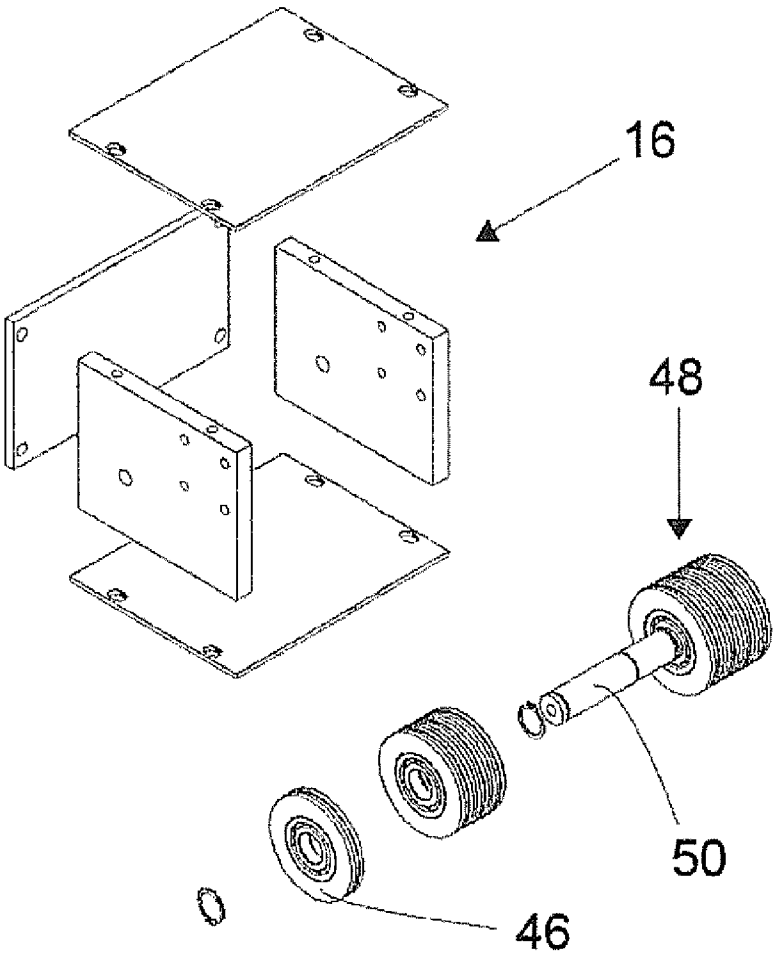
FIG. 7*a* is an exploded isometric view a tail end of the apparatus of FIG. 1.
Figure 7B:
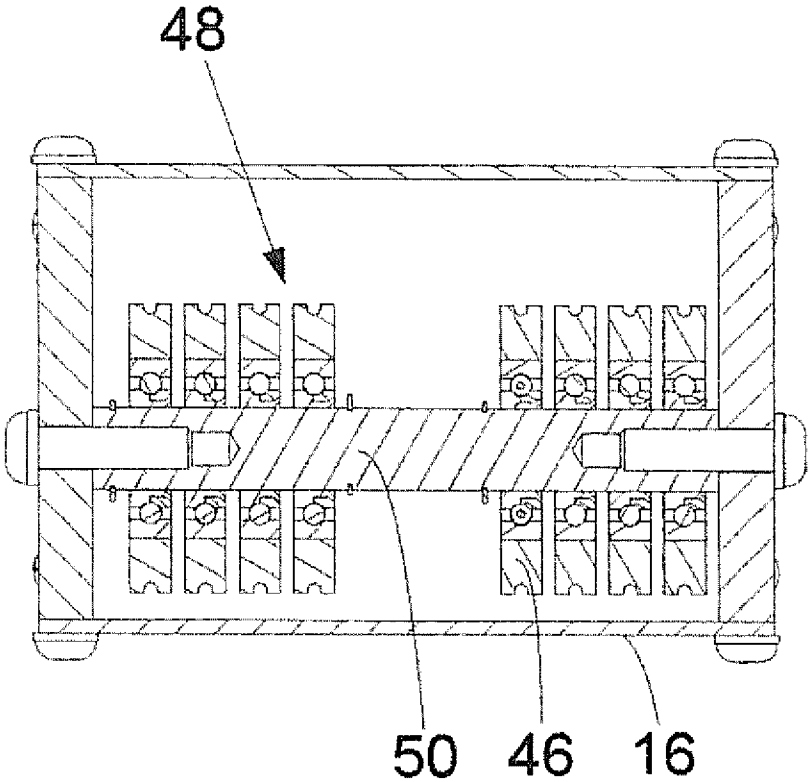
FIG. 7*b* is a cross-sectional end view of a tail end of the apparatus of FIG. 1.

A head pulley 34 is fixed to each crank shaft 32 within the frame 16 such that the head pulley 34 rotates with the crank shaft 32. Each cable 36 is secured to a corresponding guide arm 18 and makes a closed loop wrapping around a head pulley 32 and a tail pulley 46. The tail pulley assembly 48, shown in FIGS. 7*a* and 7*b*, is supported by the frame side walls 42 at the opposite end as the head pulleys 34. The tail pulley assembly 48 includes a series of independently rotable idler pulleys 46 that can be mounted on a common shaft 50 that is parallel to the crank shafts 32.

The cable-pulley system is a friction-drive system that relies on the tension of the cable 36 strained around the head pulley 34 to move and hold the guide arms 18 in their desired positions. Tension can be necessary to prevent the cable 36 from slipping on the pulley 34 when the guide arms 18 exert a force on the cable 36, such as from a residual tension of the strip material 8 or an occasional jerk resulting from the splicing of two ends of running strip material 8. Tension can also be necessary to prevent the cable 36 from slipping on the pulley 34 when the crank shaft 32 is turned to move a guide arm 18 to a desired position. The frictional resistance generated can be the product of the tension force multiplied by the coefficient of static friction between the cable and pulley materials. The frictional resistance of the cable 36 on the pulley 34 and the angle subtending the arc of contact between the pulley 34 and tension element are the primary factors that affect the design and performance of the cable-pulley friction-drive systems.

An alternative to the cable-pulley friction-drive system, which relies on the tension of a cable strained around a pulley to move and hold guide arms in their desired positions, is a chain-sprocket direct-drive system, which relies on intimately interlocking contact between chain links and sprocket teeth to move and hold guide arms to desired positions. In such a direct-drive system, tension is not required to prevent the chain from slipping on the sprocket when moving a guide arm to the desired position or when guide arms exert a force on the chain. Other direct-drive systems include gear and threaded rod drives that also rely on the intimate interlocking contact between drive elements to provide the desired motive force.

Figure 8A:
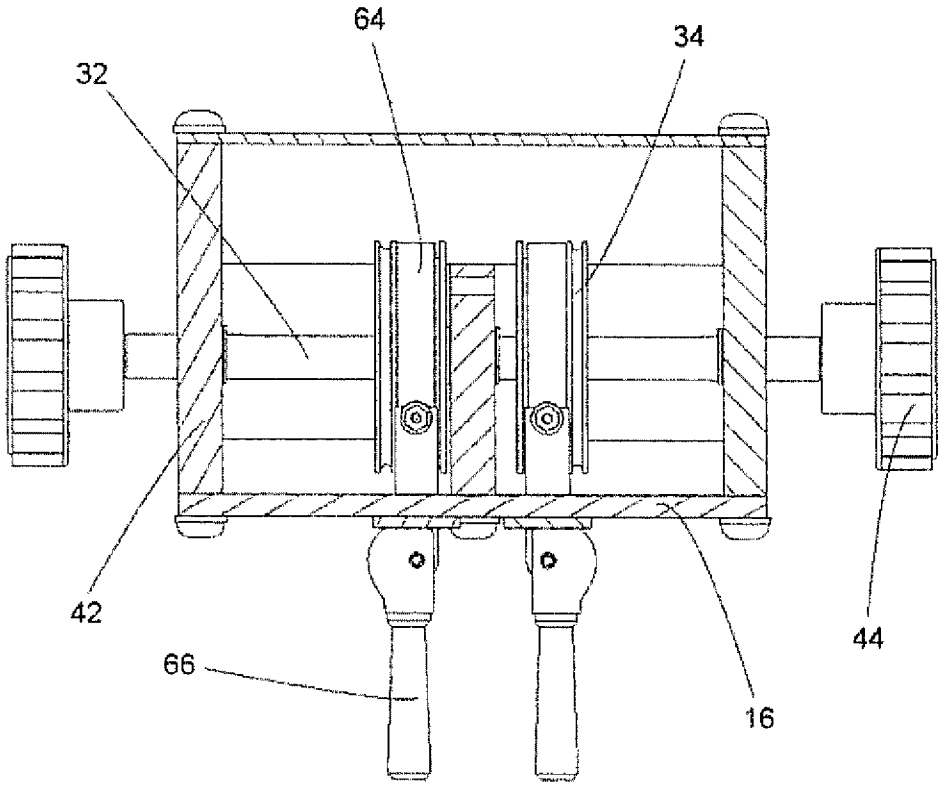
FIG. 8*a* is a cross-sectional end view of brake systems of the apparatus of FIG. 1, with the brake systems not engaged.
Figure 8B:
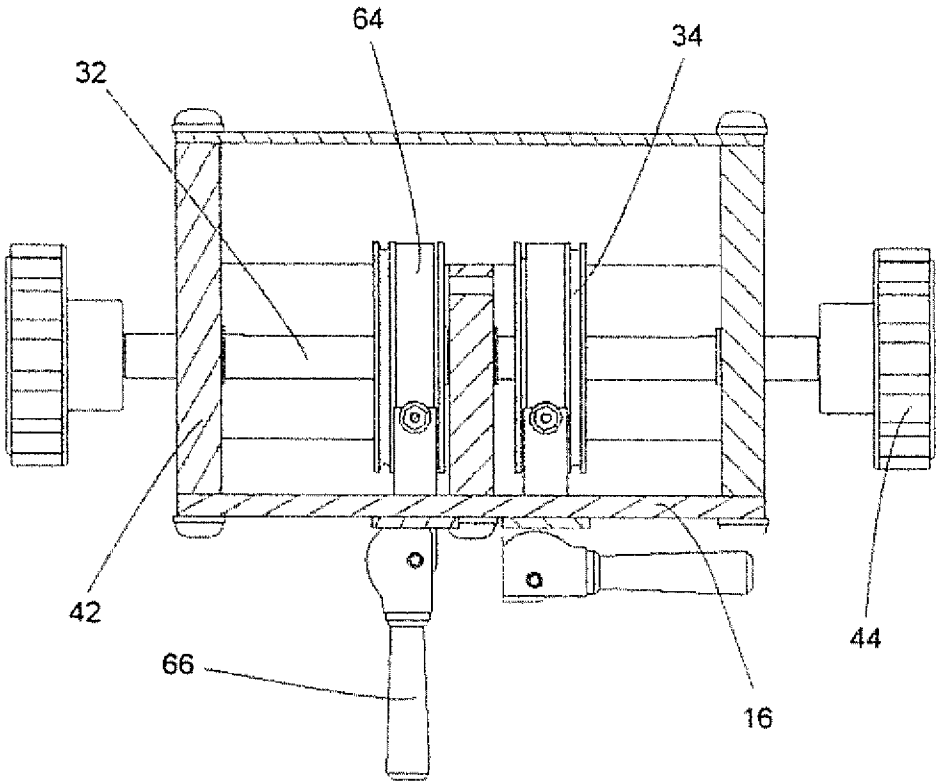
FIG. 8*b* is a cross-sectional end view of brake systems of the apparatus of FIG. 1, with one of the brake systems engaged.
Figure 8C:
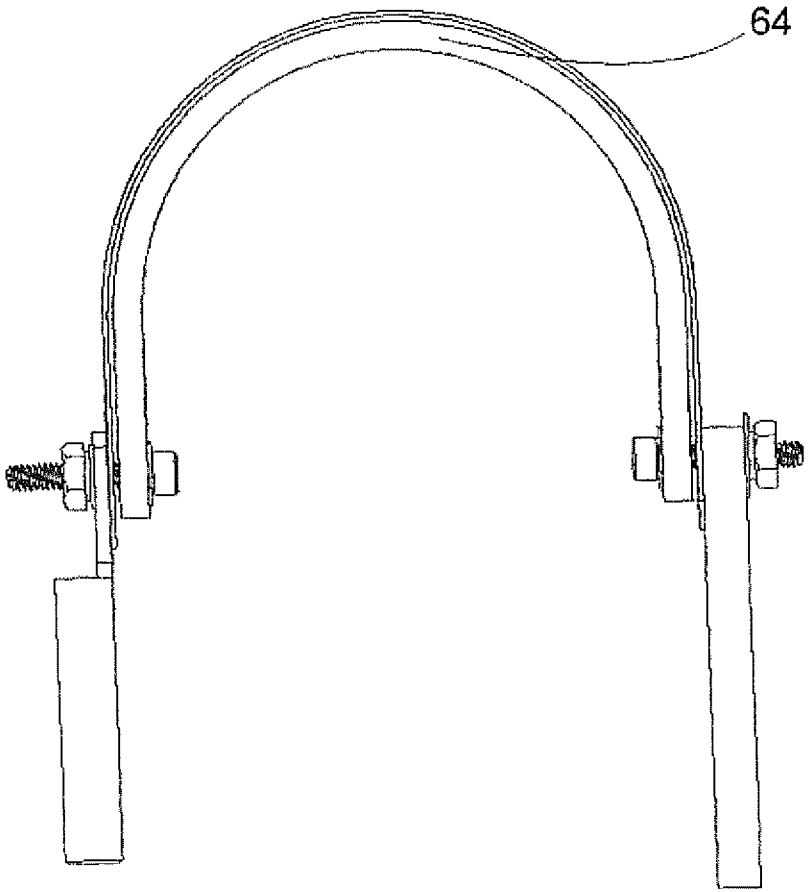
FIG. 8*c* is a detailed side view of a brake system member of the apparatus of FIG. 1.

As shown in FIG. 6, a series of brake systems 38 can be included to fix the guide arms 18 in desired positions along the guide rail 20. In one embodiment, each brake system 38 includes a horseshoe-shaped member 64, shown in FIG. 8*a*-8*c*, that wraps around a portion of a corresponding head pulley 34. This member moves into contact with and frictionally retards the rotation of the head pulley 34 when an attached brake lever 66 is actuated. One end of the horseshoe-shaped member 64 can be fixed to the frame 16 while the other end protrudes through the frame 16 and couples to the brake lever 66. The brake lever 66 can include a cam portion and can be coupled to the frame 16 such that the brake lever 66 can be actuated, as shown in FIG. 8*b*, and thereby urge the horseshoe shaped member 64 into contact with the head pulley 34. The brake system 38 can be arranged to hold the head pulley 34 in place when the lever 66 is actuated and keep the head pulley 34 stationary without maintained pressure on the lever 66.

Figure 9:
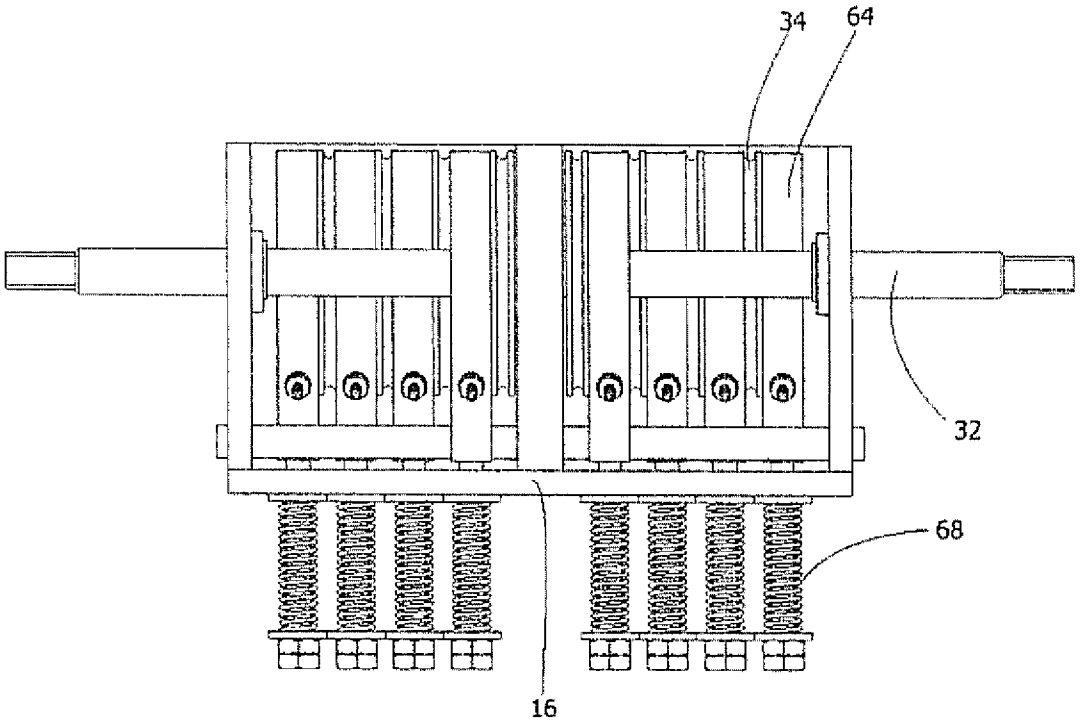
FIG. 9 is a cross-sectional end view of an alternative brake system of the apparatus of FIG. 1.

In another embodiment, shown in FIG. 9, the brake systems 38 can include a similar horseshoe-shaped friction member 64 that is biased, such as by a spring 68, to be continually pressed against a head pulley 34. The constant static friction force generated by the biased friction member 64 and the head pulley 34 can be sufficient to keep the guide arm 18 stationary against vibrations and forces applied to the guide arm 18 during operation. The constant friction force can be weak enough, however, to be overcome by manual or mechanized turning of the crank shaft 32. In this embodiment, the brake systems 38 do not need to be applied and disengaged or otherwise adjusted during operation.

Figure 10:
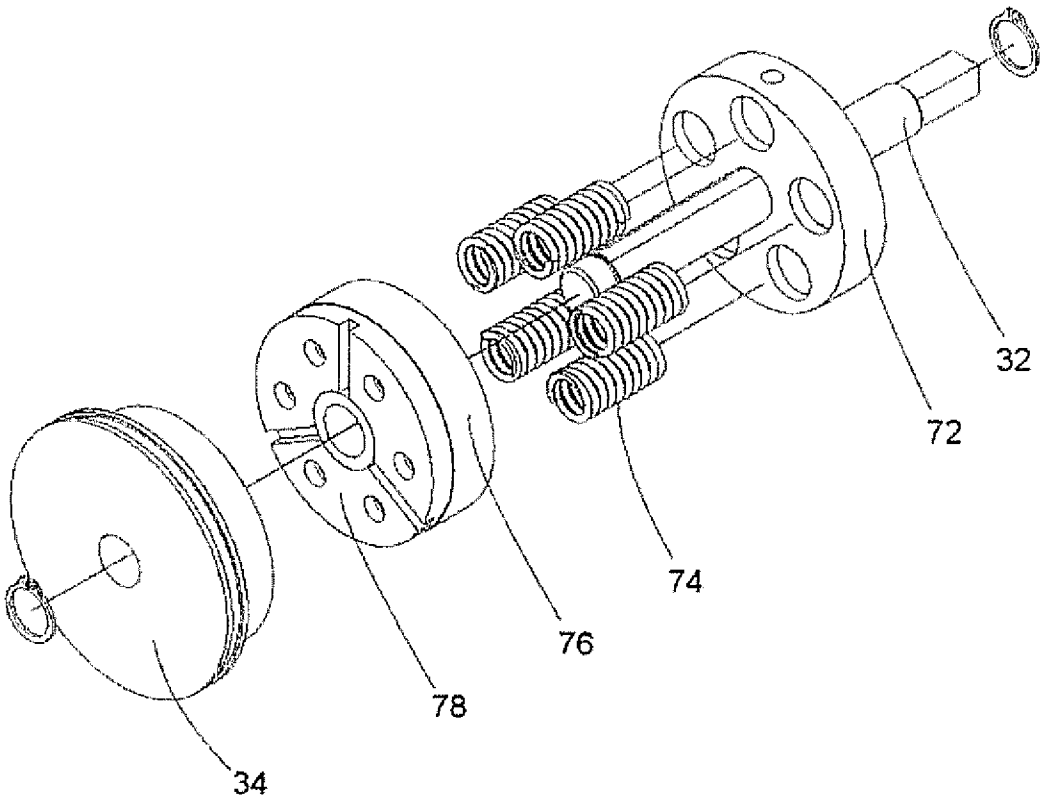
FIG. 10 is an exploded isometric view of an alternative brake system of the apparatus of FIG. 1.
Figure 11:
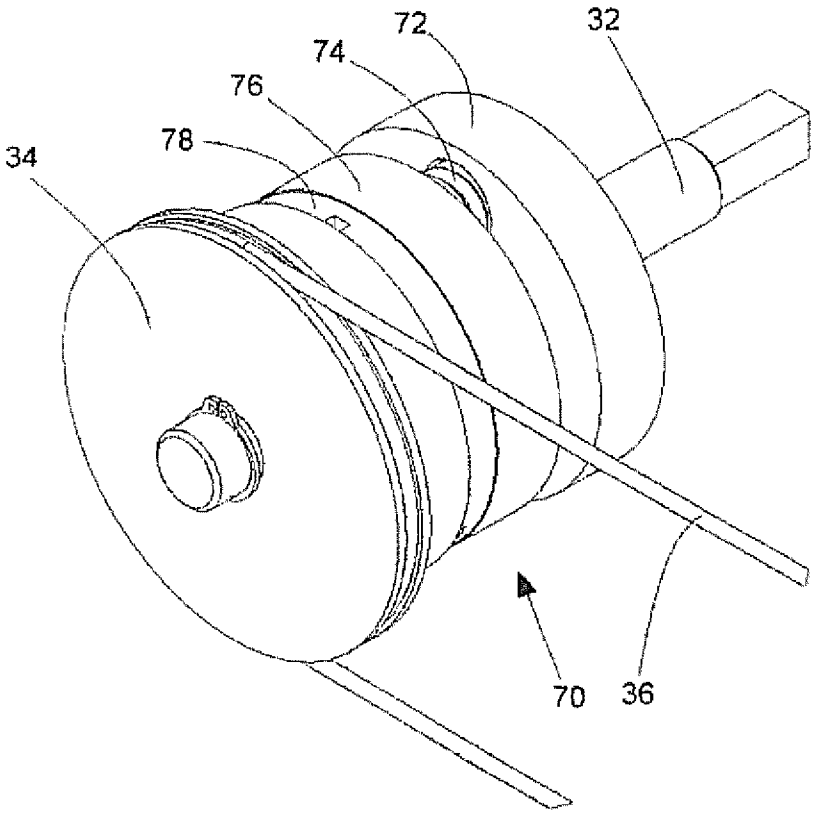
FIG. 11 is an isometric view of the brake system of FIG. 10.

In another embodiment, shown in FIGS. 10-11, the brake systems 38 can include a clutch brake system 70 mounted on each crank shaft 32. The clutch brake system 70 can include a disk-shaped back plate 72 mounted rotably on the crank shaft 32. One or more springs 74 can be fixed at one end to the back plate 72, and fixed at the other end to a clutch disk 76. The clutch disk 76 is also mounted rotably on the crank shaft 32, between the back plate 72 and the head pulley 34. The surface of the clutch disk 76 facing the head pulley 34 is lined with a friction pad 78 that can be pressed against the side of the head pulley 34 by the springs 74, as shown in FIG. 10. When the back plate 72 is fixed relative to the frame 16, the friction from the friction pad 78 against the head pulley 34 can keep the head pulley 34 from turning until the back plate 72 is released from the frame 16 by a lever or other means.

Figure 12:
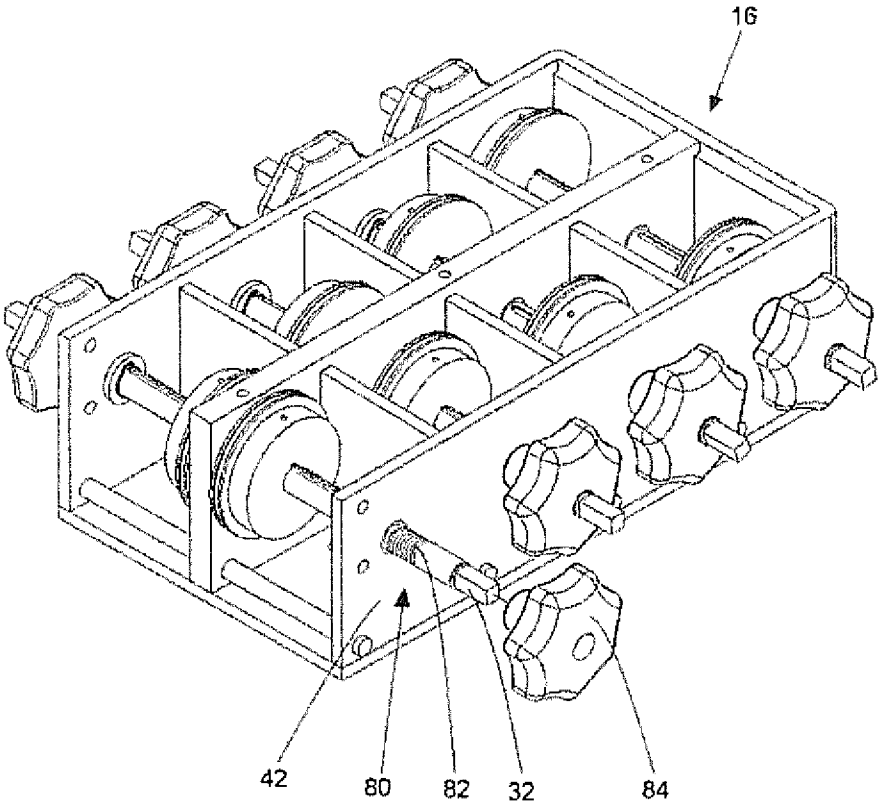
FIG. 12 is an isometric view of another alternative brake system of the apparatus of FIG. 1.

In yet another embodiment, shown in FIG. 12, the brake systems 38 can include a shaft brake 80. Each crank shaft 32 can be threaded at a location 82 near a side wall 42 of the frame 16. A nut 84 can be threaded onto the crank shaft 32. To prevent the crank shaft 32 from turning, the nut 84 can be rotated such that the nut 84 moves along the crank shaft 32 and presses against a surface of the frame 16, such as the side wall 42. A drive mechanism 44 (not shown in FIG. 12) can be coupled to the end portion of the crank shaft 32 shown in FIG. 12 as having a square cross-section.

Each of these brake system embodiments can create a friction-brake system that relies exclusively or primarily on the friction force between a surface of a friction member, such as the horseshoe-shaped member 64, the brake pad 78, or the brake nut 84, and a surface of a moving component of the drive system, such as a head pulley 34 or a crank shaft 32, to keep the guide arms 18 in their desired positions. In each embodiment, the friction force generated to restrict the motion of arm guide arm is a product of a normal force exerted upon the friction member multiplied by the coefficient of friction between the friction member and the drive system component. The normal force can be supplied by manual pressure transferred to the friction member through a suitable device, such as a lever or spring system.

Figure 13:
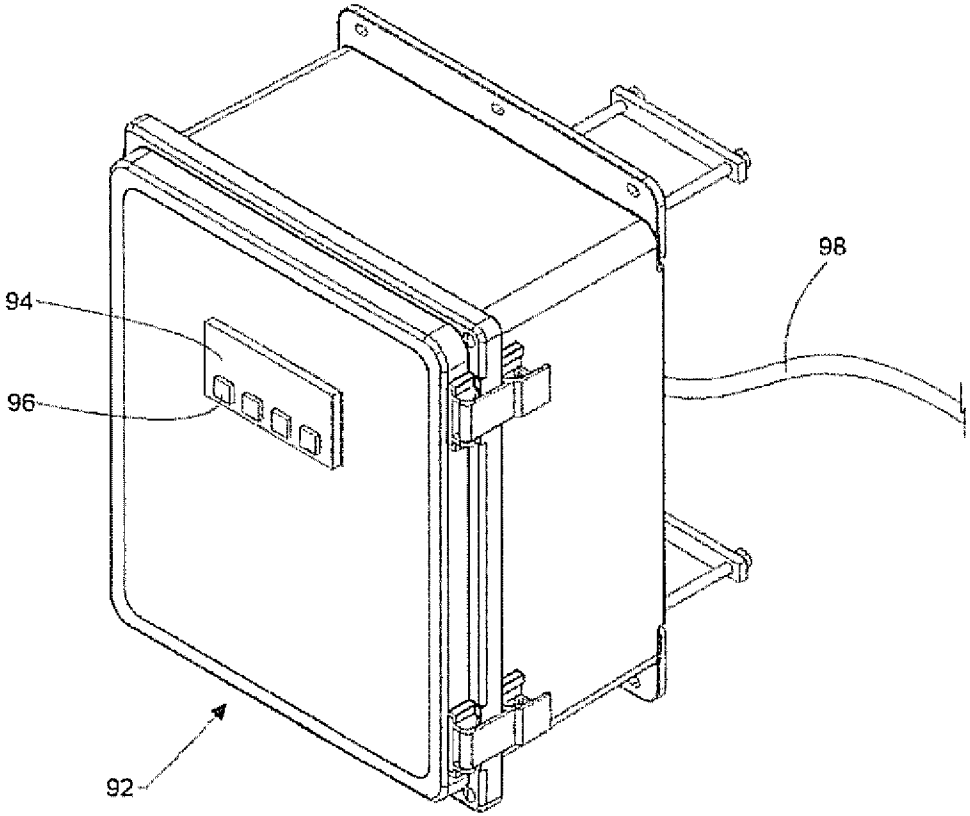
FIG. 13 is an isometric view a control panel of the apparatus of FIG. 1.

The apparatus 2 can include a system for determining the position of the guide aims 18 transversely of the substrate direction of movement or the machine direction of the substrate 6. In such a system, the linear bearing 22 of each guide arm 18 can have a magnet 88 mounted to it that cooperates with a transducer 90, as shown in FIG. 3. The frame 16 supports the transducer 90 to afford a reading as to the position of the guide arms 18 with respect to the frame 16. The transducer 90 can be connected to a control panel 92, shown in FIG. 13, having a display 94 providing a numeric digital readout giving the location along the frame 16 of the guide arms 18. The control panel 92 can have buttons 96 for user input, such as to select which arm 18 to monitor. The control panel 92 can be remotely located, and is mounted on an upright support tower 10 in one embodiment. A cable 98 connecting the transducer 90 to the control panel 92 can be routed through the frame 16 and through the hollow extension member 14, thereby keeping the cable 98 safe from harm.

The magnets 88 cooperate with the transducer 90 to afford a signal in response to a current pulse sent from the control panel 92 along the transducer 90. The signal from each arm 18 can be discerned by the electronics in the control panel 92 to calculate the distance any particular guide arm 18 is from the predetermined "0" and the numeric value can then be displayed on the display 94.

The transducer 90 and control panel 92 operation allows an operator to view the precise location of any guide arm 18. The control circuitry can trigger the transducer 90 to send a current pulse down a wire held inside the transducer 90. The current in the wire can then create an electric field about the wire. When the current flowing down the wire reaches the guide arm 18 in question, the electrical field of the wire interacts with the magnetic field of the magnet 88 on the guide arm 18. This interaction creates a torque in the wire producing a signal by the arm 18. The electronics of the transducer 90 calculate how long in time it was from when the current pulse was sent down the wire to when the reaction signal in the wire is sensed. From this information, the position of the guide arm 18 is discerned and the distance is calculated from the present "0" and a numeric value is displayed on the display of the control panel 92. The electronics can be designed to discern which magnet 88 from which to read the electric field-magnet field location signal. The operator then has a precise position reading and can adjust the arms 18 as necessary by rotating appropriate crank shafts 32.

Figure 14:
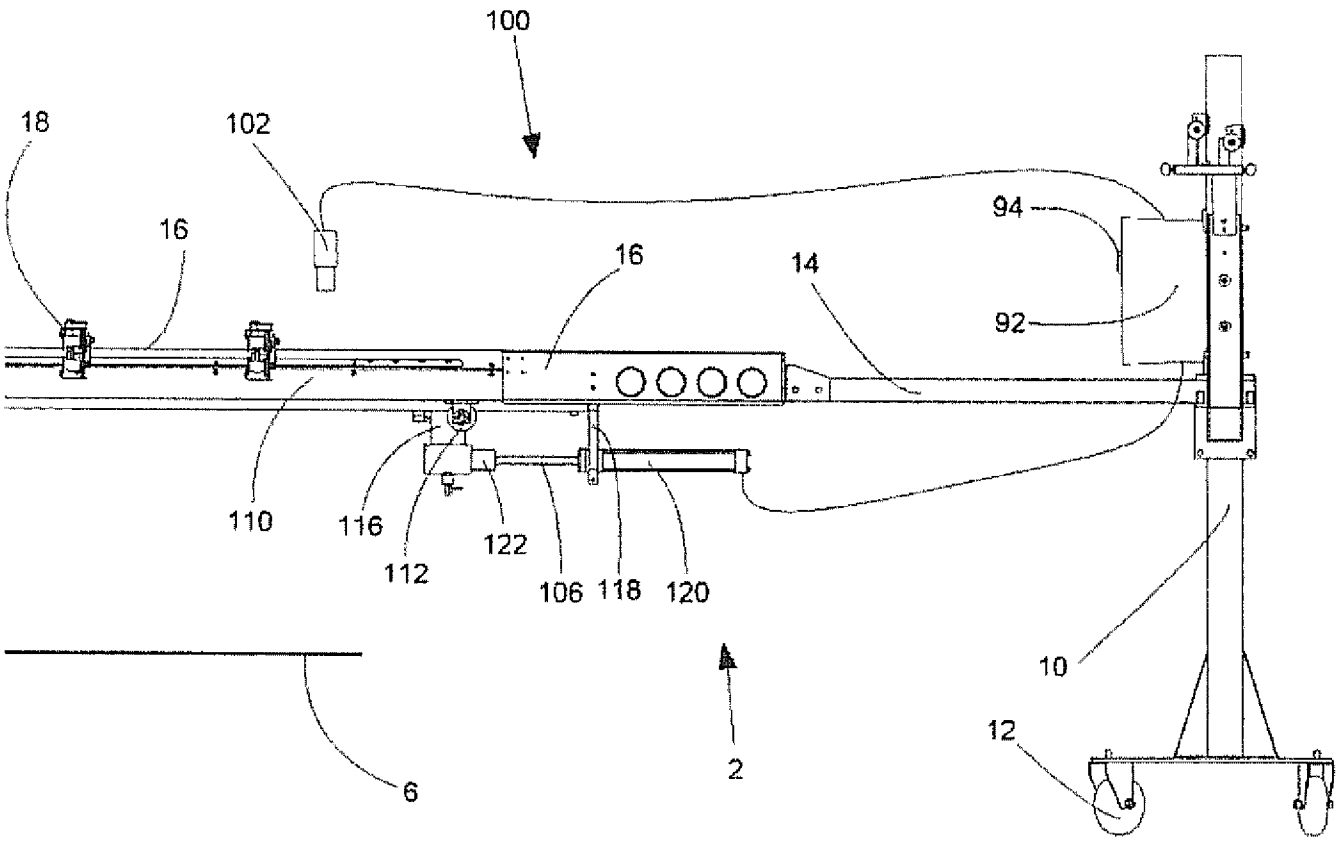
FIG. 14 is a side view of the apparatus of FIG. 1 showing a substrate tracking and adjustment system.

As shown in FIG. 14, a substrate tracking and adjustment system 100 including a substrate sensor 102, control panel 92, and actuator 106 can be used to track the position of the substrate 6 as it moves side to side from the normal substrate path or position. The substrate tracking and adjustment system 100 is used to maintain the position of a frame 16 in relation to the substrate 6. The substrate tracking sensor 102 can be placed somewhere on the substrate processing machine 4, such as upstream from the apparatus 2 as shown in FIG. 1, or the tracking sensor 102 can be affixed to the apparatus 2, preferably at a stationary location. The substrate sensor or sensors 102 can include laser, camera, proximity, pneumatic, ultrasonic, photo, optical, or other suitable sensing means.

Figure 15:
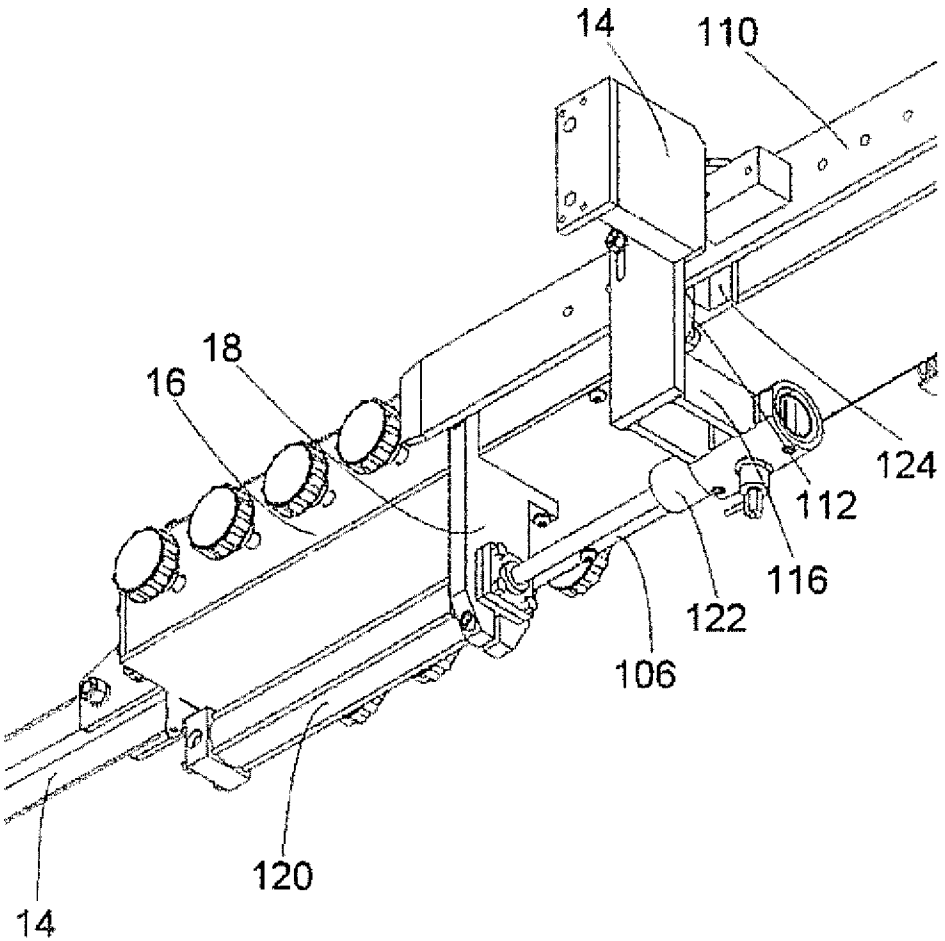
FIG. 15 is a detailed isometric view of the substrate tracking and adjustment system of FIG. 14.
Figure 16:
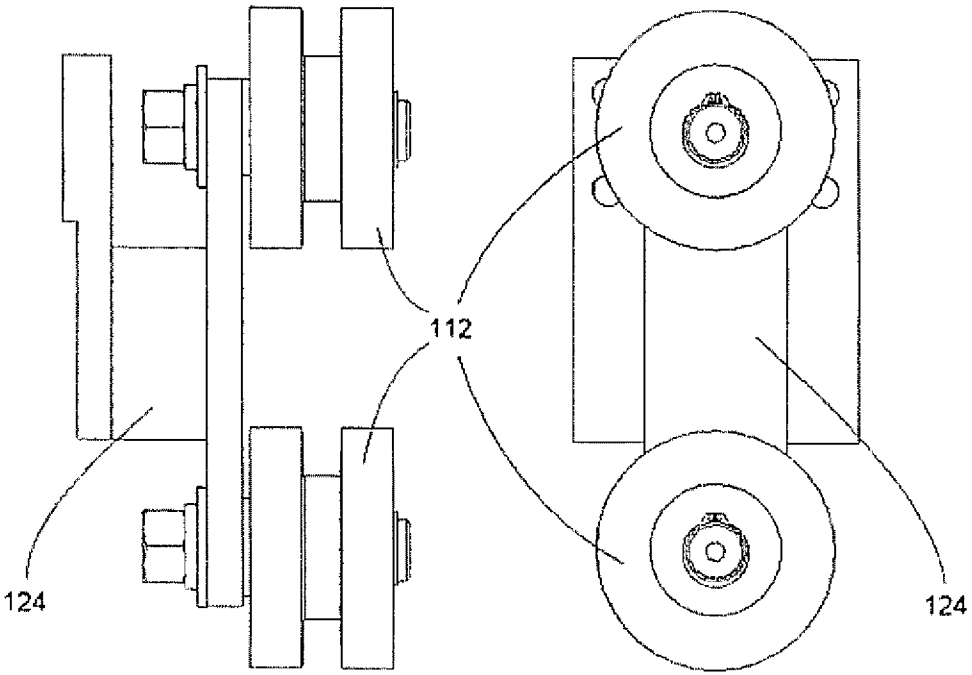
FIG. 16 is detailed orthogonal views of the guide rollers and a guide roller bracket of the substrate tracking and adjustment system of FIG. 14.

As shown in FIG. 15, a moveable end 120 of a linear actuator 106 can be secured to the frame 16 via an actuator-frame bracket 118 and a fixed end 122 of the actuator 106 can be secured to a guide track 110 via an actuator-track bracket 116. The actuator 106 can be driven hydraulically, pneumatically, magnetically, by a motor, or by other suitable driving means. The frame 16 can be mounted to the guide track 110 on two or more pairs of guide rollers 112, shown in detail in FIG. 16, so as to allow the frame 16 to freely move along the length of the guide track 110 if the frame 16 were not secured to the linear actuator 106. The pairs of guide rollers 112 can be fixed to the frame side wall 42 via guide roller brackets 124. The frame side wall 42 can be provided with multiple mounting locations along its length such that the guide roller brackets 124 can be attached at varying distance apart from each other. The actuator 106 can move the frame 16 on the guide track 110 by extending or contracting. The guide track 110 can be attached to a stationary object, such as a frame of the substrate processing machine 4, via a track bracket 114.

In one embodiment, the apparatus 2, including between one to eight guide arms 18, friction drive systems, horseshoe-type friction brake systems 38, linear bearings 22 and magnets 88, plus the transducer 90, guide rollers 112 and track brackets 114, and other necessary components, but not including the extension member 14, upright support towers 10, or guide track 110, can weigh 130 lbs to 165 lbs, depending on the number of guide arms and related systems installed.

In some embodiments, the installation of the apparatus 2 with the substrate tracking and adjustment system 100 into the operational position within a substrate processing machine 4 can be accomplished by first installing the guide track 110 and the actuator-track bracket 116 onto a stationary structural component of the substrate processing machine 4 via one or more tack brackets 114. Next, with the guide rollers 112 and liner actuator 106 pre-mounted on the frame 16, the apparatus 2 can be wheeled on two upright support towers 10, as shown in FIG. 2, into a position where the a first pair of guide rollers 112 are adjacent to an end of the guide track 110. Then, the first pair of guide rollers 112 are installed onto the guide track 110 by allowing end of the guide track 110 to move between the first pair of guide rollers 112. Next, one of the upright support towers 10 are removed and the guide track 110 supports the mounted end of the apparatus 2. Next, the apparatus 2 is further rolled into the machine 4 until the second set of guide track rollers 112 mount onto the end of the guide track 110. Finally, the fixed end 122 of the linear actuator 106 is attached to the actuator track bracket 116.

As the substrate 6 passes through the substrate processing machine 4 in the same direction as the strip material 8 application, the substrate sensor 102 can detect the transversal position of the substrate 6. The substrate sensor 102 can then transmit the substrate position information to a controller 104. The control panel 92 can then compare the substrate position to the frame's preset position. If the substrate position is not aligned to the preset frame position, the control panel 92 can send a command signal to the actuator 106 to move the frame 16 to be aligned with the substrate position. As the frame 16 is moved along the guide track 110, each of the guide arms 18 mounted on the frame 16 are simultaneously moved the same distance. This sensing, comparing, and adjusting loop can be done continuously to maintain the frame 16 and guide arms 18 in the desired position in relation to the substrate 6.

Once the apparatus is fully installed into the substrate processing machine, operation can begin. First the strip materials 8 are taken from a bulk source and threaded through or around various strip guides 130 attached to the upright support tower 10, as shown in FIG. 17. Next, the strip materials are threaded around guide arm pulleys 24 and attached to the substrate 6. Then, as the substrate moves it pulls the strip materials from the bulk source, through the guides 130 and pulleys 24 and onto the moving substrate. The strip materials can be attached to the substrate while the substrate is moving or while stationary. Furthermore, the guide arms need not be in desired transversal positions along the frame prior to attaching the strip materials to the substrate or prior to the substrate commencing movement through the machine. The guide arms can be adjusted while the substrate is moving and the strip materials are being dispensed.

To adjust the positioning of each strip of material onto the substrate, the corresponding brake systems 38 are first loosened, if needed, and then the user turns the corresponding drive mechanisms 44, which can be hand cranks, which in turn rotate crank shafts 32 and attached drive pulleys 34. The rotating drive pulleys 34, in coordination with the tail pulleys 46, moves cables 36 about a loop. When the cables 36 move, they pull the connected guide arms 18, winch slide along the frame via the guide rail 20 on bearings 22.

To measure each new position, the magnets 88 of each guide arm interact with the transducer 90 and send a signal to the control panel 92 signifying the location of each guide arm 18 in relation to a predetermined "0" location along the frame. The user can then interface with the buttons 96 and display 94 to select and read the location of each guide arm. If the guide aims are not in the desired positions, the user can then repeat these steps to adjust the guide arm positions to be more precise.

Once all the guide arms 16 are similarly moved to the desired new positions, the brake systems 38 can optionally be applied to hold them in place. The user can also manually hold the drive mechanisms 44 to hold the guide arms 16 in place. The brake systems 38 can be applied by various methods as described above, such as actuating levers or turning nuts. In the embodiment shown in FIG. 8*b*, the brake lever 66 can be rotated towards the frame side wall 42, thereby employing a cam at the base of the lever 66 to pull the attached horseshoe member 64 downward and into frictional contact with the head pulley 34. With or without the brake systems applied, typically with the brake systems applied, the strip material application process can commence.

To be more precise during the application process, the substrate tracking and adjustment system can optionally be used to automatically make transversal adjustments to all the guide arms in unison in reaction to side-to-side changes in the position of the moving substrate.

When another guide arm position change is desired, these steps can repeated to re-adjust the guide arms, for example when there is an order change to manufacture a different product. All these steps can be done without removing the apparatus from the substrate processing machine or stopping the movement of the substrate.

In view of the many possible embodiments to which the principles of the disclosed devices and methods may be applied, it should be recognized that the illustrated embodiments are only preferred examples and should not be taken as limiting the scope of the invention.

We claim:

1. An apparatus for dispensing strip materials onto at least one moving substrate, comprising:

a frame extending transversally of a substrate path of the at least one moving substrate;

at least two guide arms, each guide arm having a respective supporting means to movably attach the guide arm to the frame and having a respective dispensing means for dispensing strip materials; and a guide aim positioning system, comprising:

i) at least two crank shafts coupled to a first end of the frame, such that each of the crank shafts can rotate about a respective independent axis; and ii) at least two friction drive means, each of the friction drive means being coupled to a corresponding one of the crank shafts and a corresponding one of the guide aims, each of the friction drive means depending on frictional contact between two surfaces to transfer rotational movement of the corresponding crank shaft to linear motion of the corresponding guide arm;

wherein each of the guide arms is independently movable along the frame by rotation of the corresponding crank shaft;

wherein the guide arm positioning system further comprises at least two friction braking means, each of the friction braking means coupled to a corresponding one of the friction drive means and supported by the frame and configured to restrict movement of the corresponding guide arm;

wherein each friction braking means comprises a friction surface, the friction surface configured to press against a component of the corresponding friction drive means and restrict motion of the corresponding guide arm; and wherein a horseshoe-shaped member comprises the friction surface.

2. The apparatus of claim 1, wherein each of the friction drive means comprises:

a drive pulley fixed to the corresponding crank shaft, a tail pulley rotatably coupled to a second, opposite end of the frame, and a cable extending around the drive pulley and the tail pulley and attached to the corresponding guide arm between the drive pulley and the tail pulley.

3. The apparatus of claim 1, wherein each friction drive means is substantially physically enclosed.

4. The apparatus of claim 1, wherein the at least one moving substrate comprises a first moving substrate, and wherein a first guide arm of the at least two guide arms is disposed above a first moving substrate and a second guide arm coupled to a second frame is disposed below the first moving substrate.

5. The apparatus of claim 4, wherein the at least one moving substrate further comprises a second moving substrate located above or below the first moving substrate, and wherein one of the first and second guide arms can dispense strip materials onto the first moving substrate and the other of the first and second guide arms can dispense strip materials onto a second moving substrate.

6. The apparatus of claim 1, further comprising a guide arm position feedback system for automatically determining the transversal position of each guide arm in relation to a predetermined position and displaying the transversal positions on a display device.

7. The apparatus of claim 6, wherein the guide arm position feedback means comprises at least one magnet and at least one transducer.

8. The apparatus of claim 1, further comprising a substrate position sensor for determining a transversal position of the at least one substrate.

9. The apparatus of claim 8, further comprising an actuator configured to adjust a transversal location of the frame relative to the at least one substrate in response to a signal from the substrate position sensor and thereby adjust all of the at least two guide arms in unison relative to the at least one substrate.

10. The apparatus of claim 9, wherein the determining of the location of the substrate and the adjusting of the position of the frame relative to the substrate can be repeatedly performed to maintain the frame in a desired position in relation to the substrate.

11. An apparatus for moving at least two guide arms along a frame, comprising:

at least two crank shafts coupled to a first end portion of the frame, such that each of the crank shafts is independently rotatable about an independent rotation axis per crank shaft;

at least two drive pulleys, each of the drive pulleys being fixed to a respective one of the crank shafts;

at least two tail pulleys rotatably coupled to a second end portion of the frame; and at least two cables, each of the cables extending around a respective one of the drive pulleys and a corresponding one of the tail pulleys and attached to a corresponding one of the guide arms therebetween;

each cable and the respective one of the drive pulleys depending on frictional contact therebetween to transfer rotational movement of the crank shafts to the guide arms;

wherein each of the guide arms is independently movable along the frame by rotation of the corresponding crank shaft;

wherein the apparatus further comprises at least two friction brakes, each of the friction brakes coupled to a respective one of the drive pulleys and supported by the frame and configured to restrict movement of the corresponding guide arm;

wherein each friction brake comprises a friction surface, the friction surface configured to press against the corresponding drive pulley and restrict motion of the corresponding guide arm; and wherein a horseshoe-shaped member comprises the friction surface.

12. The apparatus of claim 11, wherein the rotation axis of each of the crank shafts is substantially perpendicular to a direction of movement of the guide arms.

13. The apparatus of claim 11, wherein two or more of the crank shafts are rotatable about non-coaxial and substantially parallel rotation axes.

14. The apparatus of claim 13, wherein two of the crank shafts are rotatable about the same axis independently.

15. The apparatus of claim 13, wherein the drive pulleys fixed to each crank shaft can rotate in separate and substantially parallel planes, the planes being perpendicular to the crank shaft rotation axes.

16. The apparatus of claim 11, wherein the at least two crank shafts comprise two or more sets of crank shafts, each set comprising two or more crank shafts that are rotatable about the same axis independently, and each set of crank shafts being rotatable about an axis that is non-coaxial and substantially parallel with the axes of the other sets of crank shafts.

17. The apparatus of claim 11, wherein each of the crank shafts can be rotated by a motorized device coupled to the crank shaft outside of the frame.

18. A process for preparing to dispense strip materials onto a moving substrate, comprising:

i) rotating plural crank shafts coupled to a first end of a frame such that each of the crank shafts rotates about an independent axis per crank shaft, the frame extending transversally of a substrate path of the moving substrate, each rotating crank shaft thereby actuating a respective one of plural friction drive means, each friction drive means being coupled to a corresponding one of the crank shafts and a corresponding one of plural guide arms, each friction drive means depending on frictional contact between two surfaces to transfer rotational movement of the corresponding crank shaft to linear motion of the corresponding guide arm, each friction drive means thereby moving the corresponding guide arm toward a desired transversal position along the frame, each guide arm having a supporting means to movably couple the guide arm to the frame and a dispensing means for dispensing strip materials onto the substrate, wherein each friction drive means is coupled to a respective friction braking means that is supported by the frame and configured to restrict movement of the corresponding guide arm, each friction braking means comprising a horseshoe-shaped member having a friction surface, the friction surface configured to press against a component of the corresponding friction drive means to restrict motion of the corresponding guide arm;

ii) using a guide arm position feedback means to automatically determine the transversal positions of the guide arms in relation to a predetermined position and display the transversal positions on a display device; and iii) repeating i and ii until the display device displays that the guide arms are at the desired transversal positions along the frame.

* * * * *